US007294234B2

(12) United States Patent
Münch et al.

(10) Patent No.: US 7,294,234 B2
(45) Date of Patent: Nov. 13, 2007

(54) PROCESS AND DEVICE FOR MONITORING THE CONDITION OF A BELT

(75) Inventors: Rudolf Münch, Königsbronn (DE); Wolfgang Ulfert, Tettnang (DE)

(73) Assignee: Voith Paper Patent GmbH, Heidenheim (DE)

( * ) Notice: Subject to any disclaimer, the term of this patent is extended or adjusted under 35 U.S.C. 154(b) by 593 days.

(21) Appl. No.: 10/689,697

(22) Filed: Oct. 22, 2003

(65) Prior Publication Data

US 2004/0129398 A1 Jul. 8, 2004

(30) Foreign Application Priority Data

Oct. 23, 2002 (DE) ..... 102 49 385

(51) Int. Cl.
*D21F 13/00* (2006.01)

(52) U.S. Cl. ..... 162/198; 162/199; 162/263; 162/272; 162/49

(58) Field of Classification Search ..... 162/198, 162/199, 263, 272; 250/340; 702/81
See application file for complete search history.

(56) References Cited

U.S. PATENT DOCUMENTS 5,960,374 A * 9/1999 Lausier ..... 702/81
6,849,851 B2 * 2/2005 Komulainen et al. ..... 250/340

OTHER PUBLICATIONS

*Metso Automation News*, Press Release, "Metso Automation announces a new era of wet end moisture management: IQInsight give insight to papermakers with instantaneous full-sheet measurement in the wet-end" (Jun. 4, 2002).
"IQInsight—a revolution in press section moisture management," <<http://www.metsoautomation.com/Automation/Paprod.nsf/WebWID/WTB-020620-225>> (Jul. 17, 2002).
*ipw*, "Companies and Markets," p. 27 (Nov. 2001).
"EV measuring technology and services," <<http://evgroup.fi/e_measure>> (Jul. 17, 2002).
Press Release, "A New Device for Machine Direction Moisture and Temperature Measurement" (Apr. 18, 2001).
"About EV Group," <<http://evgroup.fi/e_info>> (Jul. 17, 2002).

* cited by examiner

*Primary Examiner*—Mark Halpern
(74) *Attorney, Agent, or Firm*—Greenblum & Bernstein, P.L.C.

(57) ABSTRACT

Process and apparatus for monitoring the condition of a rotating belt in a paper or cardboard machine. The process includes recording data related to a condition of the belt, and creating an at least two-dimensional image of the belt condition from the recorded condition data. The image depicts a condition characteristic in a machine travel direction and a condition characteristic in a machine crosswise direction. The instant abstract is neither intended to define the invention disclosed in this specification nor intended to limit the scope of the invention in any way.

34 Claims, 2 Drawing Sheets

PROCESS AND DEVICE FOR MONITORING THE CONDITION OF A BELT

CROSS-REFERENCE TO RELATED APPLICATIONS

The present application claims priority under 35 U.S.C. § 119 of German Patent Application No. 102 49 385.5, filed on Oct. 23, 2002, the disclosure of which is expressly incorporated by reference herein in its entirety.

BACKGROUND OF THE INVENTION

1. Field of the Invention

The invention relates to a process and a device for monitoring the condition of a rotating belt, e.g., felt or wire, used in a paper or cardboard machine.

2. Discussion of Background Information

Sensors have already been used which are moved crosswise to the machine travel direction (CD) over the belt of a paper machine in order to scan it. For example moisture cross profiles of press felts are measured in this way. Until now, approx. 100 to 1000 measured values are recorded over the web width with a scan process. Since the belt, e.g., a felt, rotates several times during a scan process, an average moisture cross profile of the entire felt is obtained. However, differences in the felt condition in the machine travel direction (MD) are not recorded.

A full sheet moisture measurement process is already described in *Metso Automation News*, Press Release of Jun. 4, 2002, with which process a separation of changes resulting in the machine travel direction and in the crosswise direction is achieved. A web scanner for the online determination of the moisture cross profile of a material web, in particular a paper or cardboard web, across the full web width immediately after the press section is described in ipw November 2001, page 27.

The previous prior art has been concerned exclusively with properties of the material web.

SUMMARY OF THE INVENTION

The present invention provides a process and a device of the type mentioned at the outset with which an optimal presentation of the belt properties both in the machine travel direction and in the machine crosswise direction is possible.

Accordingly, the invention is directed to a process for monitoring the condition of a rotating belt, e.g., felt or wire, used in a paper or cardboard machine, with which process condition data of the belt are recorded by a condition sensor system and an at least two-dimensional image of the belt condition is created from the recorded condition data by an evaluation unit, which image reproduces both the condition characteristic in the machine travel direction and the condition characteristic in the machine crosswise direction. In contrast to the prior art, here this is a matter of the condition of the belt.

The condition data are preferably representative of at least one property of the belt that can be predetermined.

The image of the belt condition can be produced in particular such that this belt condition is presented in the manner of a map.

According to a preferred practical embodiment of the process according to the invention, the condition characteristic in the machine travel direction and the condition characteristic in the machine crosswise direction are reproduced in the form of contour lines and/or color transitions.

In principle a three-dimensional image or view of the belt condition can also be created, e.g., in the form of a three-dimensional grid, a three-dimensional waterfall diagram and/or the like.

The belt is advantageously scanned in the machine crosswise direction. Such a crosswise scanning can take place in particular by a scanner.

The crosswise scanning can take place over several minutes and preferably over the duration of at least one belt rotation. According to a preferred practical embodiment, the crosswise scanning takes place over the duration of several belt rotations.

The scanner can therefore be moved very slowly over the belt so that a scanning process lasts, e.g., for several minutes or corresponds to one or more belt rotations.

The condition data of the belt can be recorded continuously at a scanning rate that can be predetermined.

The condition data of the belt are preferably recorded at such a high scanning rate that a plurality of condition data is obtained during a belt rotation.

The belt rotation is advantageously recorded at the same time. This belt rotation can thereby be recorded, e.g., via a path measurement or via a time measurement and/or the like. The elongation, for example, can also be calculated from the time measurement and the speed. Such an elongation of the belt can additionally be used as a trigger for the time. Moreover, the belt can also be recorded, e.g., via at least one marking provided on or in the belt and the measurement of a corresponding trigger signal.

The at least two-dimensional image of the belt condition is preferably created from condition data that were recorded by at least one crosswise scanning of the belt conducted respectively over the duration of several belt rotations.

In order to obtain the "true" image of the belt or in order to reduce the measurement background noise, the at least two-dimensional image of the belt condition can be created from condition data that were recorded by several crosswise scans and preferably averaged and/or filtered.

The two-dimensional image of the belt allows corresponding conclusions about the belt condition even if this belt condition has changed only over a small area and these changes could no longer be recorded with the conventional measurement processes.

In order, e.g., to be able to establish whether the small-area condition differences in the belt impact the paper or cardboard quality, the at least two-dimensional image of the belt condition can be correlated with at least one predetermined property of the paper or cardboard web.

In principle a condition sensor system with one or more sensors can be used. In accordance with a practical embodiment of the process according to the invention, a condition sensor system with several successive sensors in the machine crosswise direction and/or several successive sensors in the crosswise direction is used. The same or different condition data can be recorded.

For example, a mark, a wire in particular woven in or embedded, a hole marking, a color marking and/or the like can be provided as the belt marking.

At least one trigger sensor responding to the belt marking can be used to measure the trigger signal.

In certain cases it is also advantageous if at least one trigger sensor is used respectively on both sides of the paper or cardboard machine. Thus, e.g., an oblique felt seam (felt draw) can also be retraced and, e.g., a color card can be drawn relative to the felt seam even if it runs obliquely.

In particular several condition sensors can also be assigned to the scanner or to the condition sensor system, whereby the measuring time is reduced while the measurement resolution remains constant.

Further, the invention is directed to a device for monitoring the condition of a rotating belt used in a paper or cardboard machine, in particular for carrying out the process according to one of the preceding claims, with a condition sensor system for recording condition data of the belt and an evaluation unit for creating an at least two-dimensional image of the belt condition from the recorded condition data, which image reproduces both the condition characteristic in the machine travel direction and the condition characteristic in the machine crosswise direction.

The condition data to be recorded can be, e.g., one or more of the following values: water absorbency, water content, optical properties, temperature, compressibility (elasticity), thickness, contamination, steaming and/or the like.

The present invention is directed to a process for monitoring the condition of a rotating belt in a paper or cardboard machine. The process includes recording data related to a condition of the belt, and creating an at least two-dimensional image of the belt condition from the recorded condition data. The image depicts a condition characteristic in a machine travel direction and a condition characteristic in a machine crosswise direction.

According to a feature of the invention, the rotating belt is one of a felt or wire.

In accordance with another feature of the present invention, the condition data can be recorded by a condition sensor system, and the image may be created by an evaluation unit.

The condition data can represent at least one predetermined property of the belt, and the at least one predetermined property of the belt can be permeability.

According to the instant invention, the image may be created in the form of a map.

Further, the condition characteristic in the machine travel direction and the condition characteristic in the machine crosswise direction may be depicted in the form of at least one of contour lines and color transitions.

The at least two-dimensional image can include a three-dimensional image. Moreover, the three-dimensional image can be depicted in the form of at least one of a three-dimensional grid, and a three-dimensional waterfall diagram.

In accordance with still another feature of the invention, the process can further include scanning the belt in the machine crosswise direction. In this regard, the scanning can be conducted by a scanner. Further, the scanning may be performed over several minutes. Also, the scanning can be performed over a duration of at least one belt rotation. The scanning can also be performed over a duration of several belt rotations. The condition data can be continuously recorded at a predetermined scanning rate. Still further, the condition data may be recorded at a scanning rate in which a plurality of condition data is obtained during a belt rotation.

The process may further include recording belt rotation concurrently with the recording of condition data. The belt rotation can be recorded via a path measurement. Further, the belt rotation may be recorded via a time measurement. Also, the belt rotation can be recorded via at least one marking provided on or in the belt and a detection of a corresponding trigger signal.

According to the instant invention, the condition data can be recorded by at least one crosswise scanning of the belt conducted over a duration of several belt rotations.

Further, the condition data may be recorded by several crosswise scans of the belt. The several crosswise scans can be at least one of averaged and filtered.

According to still another feature of the invention, the condition data can be correlated with at least one predetermined property of the paper or cardboard web.

Moreover, the recording can be performed by a condition sensor system comprising at least one sensor. The condition sensor system can include at least one of a plurality of sensors successively arranged in the machine crosswise direction and a plurality of sensors successively arranged in the crosswise direction.

In accordance with the process, the belt may include at least one of an optical marking and a hole marking. The optical marking may include a wire woven into the belt. Further, at least one trigger sensor can be positioned to detect the belt marking, and the at least one trigger sensor can emit a trigger signal.

Still further, at least one trigger sensor can be used on each side of the paper or cardboard machine.

According to the invention, a plurality of condition sensors may be assigned to a scanner.

The present invention is directed to an apparatus for monitoring the condition of a rotating belt used in a paper or cardboard machine in accordance with the above-discussed process. The apparatus can include a condition sensor system for recording the condition data of the belt, and an evaluation unit structured and arranged to create the at least two-dimensional image of the belt condition from the recorded condition data.

The apparatus can also include a triggering element coupled to the belt and a trigger sensor positioned to detect the triggering element.

Further, the condition sensor system comprises at least one sensor arranged to scan the belt in the machine crosswise direction.

The present invention is also directed to an apparatus for monitoring the condition of a rotating belt in a paper or cardboard machine. The apparatus includes a condition sensor system for recording data related to a condition of the belt, and an evaluation unit structured and arranged to create an at least two-dimensional image of the belt condition from the recorded condition data. The image created depicts a condition characteristic in a machine travel direction and a condition characteristic in a machine crosswise direction.

In accordance with still yet another feature of the invention, a triggering element can be coupled to the belt and a trigger sensor positioned to detect the triggering element. Moreover, the condition sensor system can include at least one sensor arranged to scan the belt in the machine crosswise direction.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
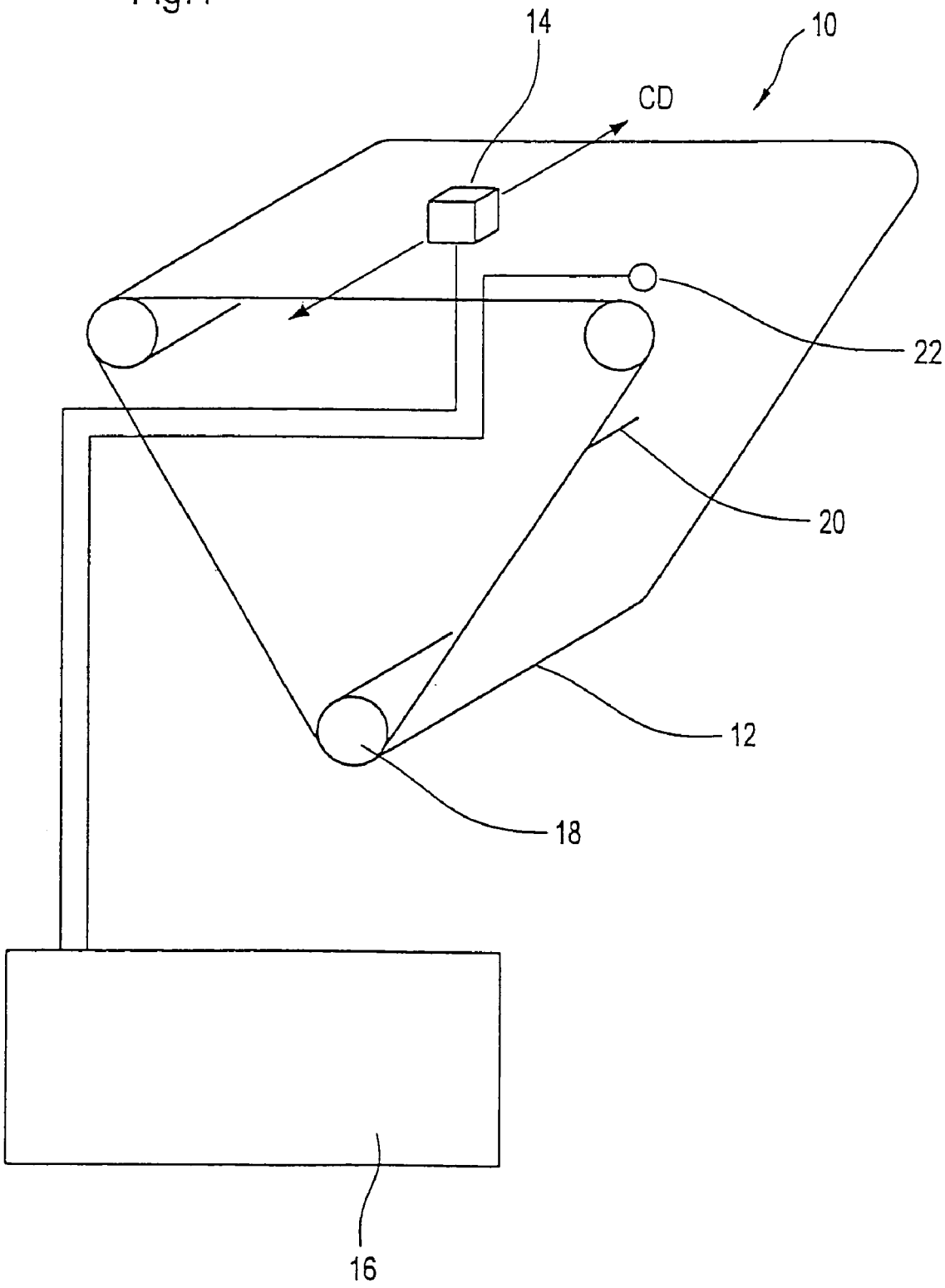
FIG. 1 diagrammatically illustrates a device for monitoring the condition of a rotating belt, here, e.g., a felt.

FIG. 1 shows a diagrammatic representation of a device 10 for monitoring the condition of a rotating belt used in a paper or cardboard machine, here, e.g., a felt 12.

The device 10 comprises a condition sensor system or scanner 14 for recording condition data of the felt 12 and an evaluation unit 16 for creating an at least two-dimensional image of the felt condition from the recorded condition data, which image reproduces both the condition characteristic in the machine travel direction and the condition characteristic in the machine crosswise direction. The evaluation unit 16 can comprise in particular a computer and/or the like. The felt 12 is guided around several rolls 18.

The condition data recorded via the condition sensor system 14 can be representative of at least one predetermined property of the felt, e.g., permeability.

Figure 2:
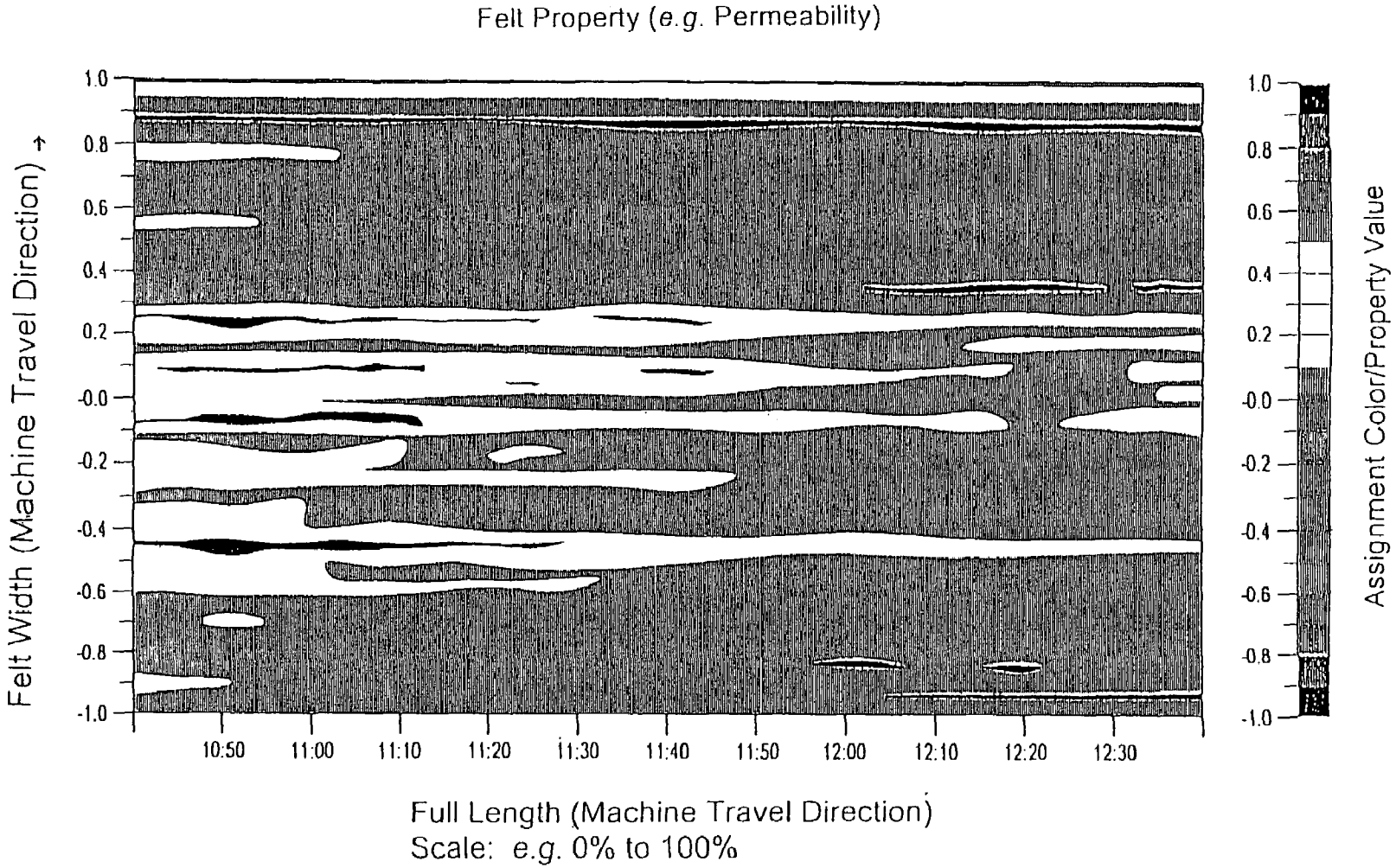
FIG. 2 illustrates a two-dimensional (e.g., color) image of the belt condition, here, e.g., the permeability of a felt.

The e.g. color image of the felt condition can be created in particular such that this felt condition is reproduced in the manner of a map. The condition characteristic in the machine travel direction and the condition characteristic in the machine crosswise direction can be reproduced thereby, e.g., in the form of contour lines and/or color transitions. Such a two-dimensional image of the felt condition, here the felt permeability, is shown in FIG. 2. Various scales are conceivable, in the present case, e.g., felt length (0% to 100%).

The condition sensor system 14 can comprise one or more sensors. It is moved in the machine crosswise direction CD.

The felt rotation is recorded via at least one marking 20 provided on or in the felt 12 and the measurement of a corresponding trigger signal by a trigger sensor 22.

The evaluation unit 16 is designed in particular for a measured data collection for the position of the condition sensor system 14 in the machine crosswise direction, the quality or property signals and the trigger signal, and for computing the two-dimensional image (cf. also FIG. 2) of the felt 12. The corresponding representation can thereby be, e.g., independent of the length elongation of the felt 12.

The rotating felt 12 is scanned by the condition sensor system 14, e.g., in the machine crosswise direction. The condition sensor system 14 can thus comprise in particular a scanner or the like. The crosswise scanning takes place while the felt 12 is rotating.

The condition sensor system 14 or the scanner thereby moves very slowly over the belt, here, e.g., the felt 12. A traversing or a scanning process takes several minutes and corresponds to m felt rotations. The condition data of the felt 12 are continuously recorded at a very high scanning rate, so that during a felt rotation, e.g., n values are recorded. The felt rotation is recorded simultaneously via a path measurement or more simply via a marking 20 (cf. FIG. 1) on the felt 12 and a trigger signal measured via a trigger sensor 22 (cf. FIG. 1).

After a scanning process, m·n measured values are available that are assigned to m felt rotations. From these m·n values and the trigger information (or the path measurement), e.g., a desired color card can thus be drawn, which color card correspondingly contains m values in the machine travel direction and n values in the machine crosswise direction.

In order to obtain the "true" image of the felt 12 or in order to reduce the measurement background noise, several scan processes can be conducted and the relevant values recorded and averaged or filtered. For example, after the scanning process k an indicated measured value $a_k$ is obtained for a specific place on the felt 12, which value is calculated from the formula given below from the current measured value $m_k$ and the last shown measured value $a_{k-1}$:

$$a_k=0.2\ m_k+0.8\ a_{k-1}.$$

In principle, any other filter formulae are also conceivable.

The condition sensor system 14 can comprise one or more sensors, e.g., successive sensors in the machine crosswise direction.

For example, a mark, a wire in particular woven in or embedded, a hole marking, a color marking and/or the like can be provided as a belt marking 20.

In principle, trigger sensors 22 can also be provided on both sides of the machine. An oblique felt seam (felt draw) can also be retraced with them, and the color card (cf. FIG. 2) can be drawn relative to the felt seam even if the felt seam runs obliquely.

The scales provided in the two-dimensional image of FIG. 2 are given purely by way of example. Both scales can also be in particular local:

x=felt length in % y=felt width in mm

The felt length is measured relative to the position of the trigger signal. The position of the trigger signal relative to the felt seam should be known. Ideally these positions are identical.

The following is a possible alternative:

x=felt length in mm y=felt width in mm

Although in this case the felt length increases with time, the advantage is that a change in length remains visible.

Another example is the felt width in %, e.g., with web edges scanning, e.g., optically or inductively.

For example, a two-dimensional image of the belt condition can thus be created which shows the belt properties in the manner of a map. The representation of the properties in the machine travel direction and in the machine crosswise direction can be made, e.g., in the form of contour lines or color transitions, e.g., as in maps. In principle, three-dimensional views, such as, e.g., three-dimensional grids, waterfall diagrams and/or the like, are also conceivable.

The two-dimensional image of the belt, e.g., felt or wire, allows conclusions about the belt condition even if the condition is changed only over a small area and it would no longer be possible to record such a change with the conventional measuring methods. The two-dimensional image can also be correlated with paper or cardboard properties in order to be able to establish whether the small-area differences in condition in the belt impact the paper or cardboard quality. Similar observations are also obtained with a use of the invention with other belts (e.g., forming wires) or the use of other sensors (e.g., permeability measurement, etc.).

It is noted that the foregoing examples have been provided merely for the purpose of explanation and are in no way to be construed as limiting of the present invention.

While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMBERS

10 Device
12 Belt, felt
14 Condition sensor system, scanner
16 Evaluation unit
18 Roll
20 Marking
22 Trigger sensor

What is claimed:

1. A process for monitoring the condition of a rotating belt in a paper or cardboard machine, comprising:

recording data related to a condition of the belt; and creating an at least two-dimensional image of the belt condition from the recorded condition data, wherein the image depicts a condition characteristic in a machine travel direction and a condition characteristic in a machine crosswise direction, wherein the condition characteristic in the machine travel direction and the condition characteristic in the machine crosswise direction are depicted in the form of at least one of contour lines and color transitions.

2. The process in accordance with claim 1, wherein the rotating belt is one of a felt or wire.

3. The process in accordance with claim 1, wherein the condition data is recorded by a condition sensor system, and the image is created by an evaluation unit.

4. The process in accordance with claim 1, wherein the condition data represent at least one predetermined property of the belt.

5. The process in accordance with claim 4, wherein the at least one predetermined property of the belt is permeability.

6. The process in accordance with claim 1, wherein the image is created in the form of a map.

7. The process in accordance with claim 1, wherein the at least two-dimensional image comprises a three-dimensional image.

8. The process in accordance with claim 7, wherein the three-dimensional image is depicted in the form of at least one of a three-dimensional grid, and a three-dimensional waterfall diagram.

9. The process in accordance with claim 1, further comprising scanning the belt in the machine crosswise direction.

10. The process in accordance with claim 9, wherein the scanning is conducted by a scanner.

11. The process in accordance with claim 9, wherein the scanning is performed over several minutes.

12. The process in accordance with claim 9, wherein the scanning is performed over a duration of at least one belt rotation.

13. The process in accordance with claim 9, wherein the scanning is performed over a duration of several belt rotations.

14. The process in accordance with claim 9, wherein the condition data are continuously recorded at a predetermined scanning rate.

15. The process in accordance with claim 9, wherein the condition data are recorded at a scanning rate in which a plurality of condition data is obtained during a belt rotation.

16. The process in accordance with claim 1, further comprising recording belt rotation concurrently with the recording of condition data.

17. The process in accordance with claim 16, wherein the belt rotation is recorded via a path measurement.

18. The process in accordance with claim 16, wherein the belt rotation is recorded via a time measurement.

19. The process in accordance with claim 16, wherein the belt rotation is recorded via at least one marking provided on or in the belt and a detection of a corresponding trigger signal.

20. The process in accordance with claim 1, wherein the condition data are recorded by at least one crosswise scanning of the belt conducted over a duration of several belt rotations.

21. The process in accordance with claim 1, wherein the condition data are recorded by several crosswise scans of the belt.

22. The process in accordance with claim 21, wherein the several crosswise scans are at least one of averaged and filtered.

23. The process in accordance with claim 1, wherein the condition data is correlated with at least one predetermined property of the paper or cardboard web.

24. The process in accordance with claim 1, wherein the recording is performed by a condition sensor system comprising at least one sensor.

25. The process in accordance with claim 24, wherein the condition sensor system comprises at least one of a plurality of sensors successively arranged in the machine crosswise direction and a plurality of sensors successively arranged in the crosswise direction.

26. The process in accordance with claim 1, wherein the belt includes at least one of an optical marking and a hole marking.

27. The process in accordance with claim 26, wherein the optical marking comprises a wire woven into the belt.

28. The process in accordance with claim 26, wherein at least one trigger sensor is positioned to detect the belt marking.

29. The process in accordance with claim 28, wherein the at least one trigger sensor emits a trigger signal.

30. The process in accordance with claim 1, wherein at least one trigger sensor is used on each side of the paper or cardboard machine.

31. The process in accordance with claim 1, wherein a plurality of condition sensors are assigned to a scanner.

32. A process for monitoring the condition of a rotating belt in a paper or cardboard machine, comprising:

recording data related to a condition of the belt; and creating an at least two-dimensional image of the belt condition from the recorded condition data, wherein the image depicts a condition characteristic in a machine travel direction and a condition characteristic in a machine crosswise direction, wherein the condition data represent at least one predetermined property of the belt, wherein the at least one predetermined property of the belt is permeability.

33. The process in accordance with claim 32, wherein the condition characteristic in the machine travel direction and the condition characteristic in the machine crosswise direction are depicted in the form of at least one of contour lines and color transitions.

34. The process in accordance with claim 32, wherein the at least two-dimensional image comprises a three-dimensional image.

* * * * *